US009612071B2

(12) United States Patent
Berte et al.

(10) Patent No.: US 9,612,071 B2
(45) Date of Patent: Apr. 4, 2017

(54) SPEED RELOADER FOR BOLT ACTION FIXED RIFLE

(71) Applicant: BOLT ACTION CONCEPTS, LLC, West Allis, WI (US)

(72) Inventors: Michael Berte, West Allis, WI (US); Joshua Martinez, Jacksonville, FL (US)

(73) Assignee: BOLT ACTION CONCEPTS, LLC, West Allis, WI (US)

( * ) Notice: Subject to any disclaimer, the term of this patent is extended or adjusted under 35 U.S.C. 154(b) by 0 days.

(21) Appl. No.: 15/150,519

(22) Filed: May 10, 2016

(65) Prior Publication Data

US 2017/0023323 A1 Jan. 26, 2017

Related U.S. Application Data

(62) Division of application No. 13/953,320, filed on Jul. 29, 2013, now Pat. No. 9,335,107.

(51) Int. Cl.

| | |
|---|---|
| ***F41A 9/82*** | (2006.01) |
| ***F41A 9/83*** | (2006.01) |
| ***F41A 9/24*** | (2006.01) |
| ***F41A 3/22*** | (2006.01) |

(52) U.S. Cl.
CPC *F41A 9/83* (2013.01); *F41A 3/22* (2013.01); *F41A 9/24* (2013.01)

(58) Field of Classification Search
CPC ..... F41A 9/24; F41A 9/83; F41A 9/84
See application file for complete search history.

(56) References Cited

U.S. PATENT DOCUMENTS

| | | | |
|---|---|---|---|
| 278,980 | A | 6/1883 | Livermore et al. |
| 356,276 | A | 1/1887 | Diss |
| 447,577 | A | 3/1891 | Milovanovitch-Koka |
| 506,323 | A | 10/1893 | Lee |
| 522,604 | A | 7/1894 | Lee |
| 578,931 | A | 3/1897 | Johnson |
| 600,366 | A | 3/1898 | Johnson |
| 2,122,003 | A | 6/1938 | Cooper |
| 2,137,680 | A | 11/1938 | Vogel |
| 2,503,741 | A | 4/1950 | Johnson |
| 2,756,913 | A | 7/1956 | Oswald |
| 2,779,522 | A | 1/1957 | Puckett |
| 2,825,991 | A | 3/1958 | Stadelmann |
| 2,894,350 | A | 7/1959 | Janson |
| 3,030,724 | A | 4/1962 | Curran |
| 3,219,244 | A | 11/1965 | Blask |
| 3,242,609 | A | 3/1966 | Koistinen |
| 3,669,249 | A | 6/1972 | Foster |
| 3,789,531 | A | 2/1974 | Kersten |
| 4,352,254 | A | 10/1982 | Peter et al. |
| 4,583,659 | A | 4/1986 | Carter |
| 4,805,333 | A | 2/1989 | Doria et al. |
| 5,402,594 | A | 4/1995 | Switzer |
| 5,561,933 | A | 10/1996 | Czekalski |

(Continued)

*Primary Examiner* — Gabriel Klein
(74) *Attorney, Agent, or Firm* — Ryan Kromholz & Manion, S.C.

(57) ABSTRACT

A loading apparatus and method for use with a firearm, which may be most suited for use with a bolt-action rifle having an internal magazine. The loading apparatus comprises an arcuate shaped body having a coextensive track, flap member, and access slot, and a guidance element, all of which combine to provide an apparatus that increases the ease and speed of loading the firearm.

4 Claims, 5 Drawing Sheets

(56) References Cited

U.S. PATENT DOCUMENTS

| | | | |
|---|---|---|---|
| 6,000,589 | A | 12/1999 | Burdine |
| 6,154,997 | A | 12/2000 | Aluotto et al. |
| 6,178,683 | B1 | 1/2001 | Williams |
| 6,286,243 | B1 | 9/2001 | Hinton |
| D477,047 | S | 7/2003 | Springer |
| 6,678,985 | B2 | 1/2004 | Pikula |
| 6,810,616 | B2 | 11/2004 | Tal et al. |
| 6,817,133 | B1 | 11/2004 | Williams |
| 6,817,134 | B2 | 11/2004 | Newman |
| 7,503,138 | B2 | 3/2009 | Tal et al. |
| 7,637,048 | B2 | 12/2009 | Tal et al. |
| 7,854,083 | B1 | 12/2010 | Aalto |
| 7,941,955 | B2 | 5/2011 | Stone |
| D661,770 | S | 6/2012 | Thunberg |
| 2007/0017140 | A1 | 1/2007 | Pikielny |
| 2007/0137086 | A1 | 6/2007 | Price |
| 2010/0313460 | A1 | 12/2010 | Tucker |

SPEED RELOADER FOR BOLT ACTION FIXED RIFLE

RELATED APPLICATION

This application is a divisional of co-pending U.S. patent application Ser. No. 13/953,320, filed 29 Jul. 2013, now U.S. Pat. No. 9,335,107.

BACKGROUND OF THE INVENTION

Firearms, more specifically, firearms utilizing a bolt-action are well known in the art. There are many benefits of using a bolt-action rifle over rifles using different loading and ejecting mechanisms. For example, certain semi-automatic and automatic firearms expend some of the energy from the charge of the ammunition to ejecting the spent shell and loading a new bullet into the chamber. This may affect muzzle velocity and therefore accuracy.

Additionally, bolt-action rifles permit a user to eject a spent cartridge and reload in a single, low-strain manual action, unlike pump-action firearms which require the operator to move the fore-end relative to the barrel, making them harder to use in situations where the user is laying down. However, one potential drawback to using a bolt-action firearm is the inability to load ammunition quickly at various angles without much overall body movement.

SUMMARY OF THE INVENTION

The present invention relates to an ammunition loader, more particularly a speed reloader for a bolt-action rifle. The reloader employs an ammunition alignment pocket which allows for effortless insertion of ammunition into the reloader and fluid transfer of the ammunition from the reloader to the firearm magazine, and an engagement lip to achieve proper alignment of the reloader and to provide directed guidance for the ammunition into the magazine.

DESCRIPTION OF THE PREFERRED EMBODIMENT

Although the disclosure hereof is detailed and exact to enable these skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
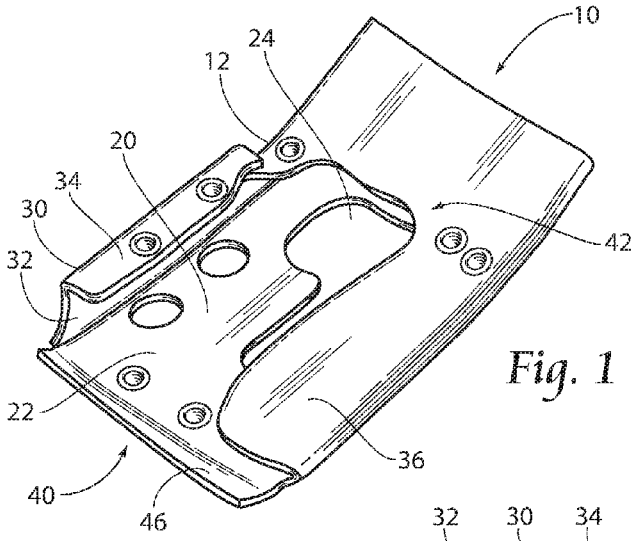
FIG. 1 is a front perspective view of a reloader incorporating the ammunition alignment system and engagement lip according to the present invention.
Figure 2:
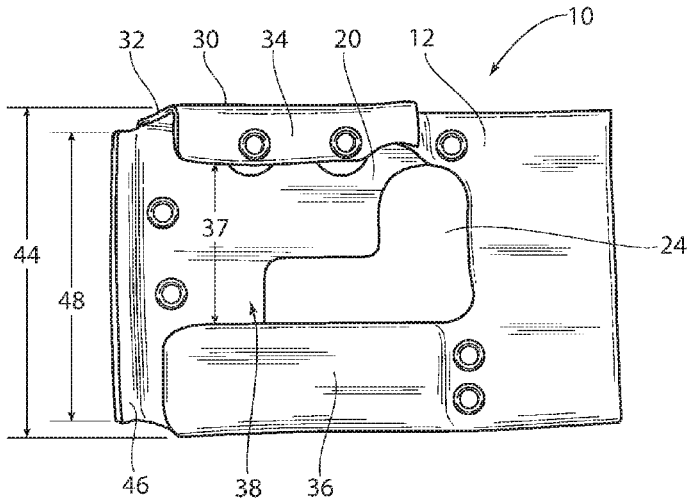
FIG. 2 is a front view of the reloader according to the present invention.
Figure 3:
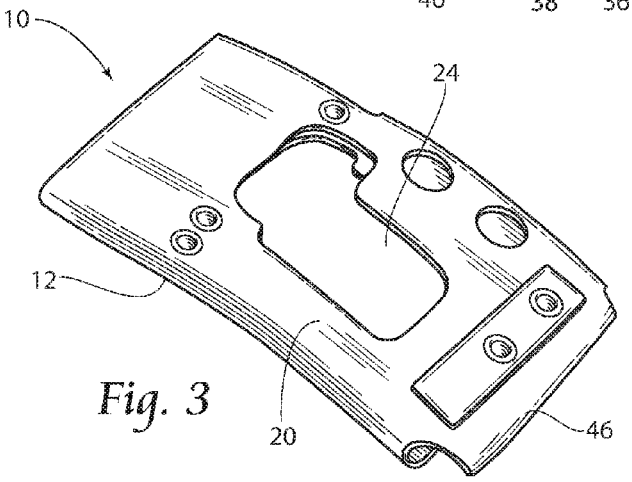
FIG. 3 is a rear perspective view of the reloader of FIG. 1 with a rear aperture.

With specific attention to FIGS. 1-3, a loader 10 according to the present invention may be seen. The loader 10 comprises a body 12 of overall arcuate shape having a base member 20 having an inside surface 22, at least one coextensive track member 30, a flap member 36, an open end 40, and a closed end 42; and a guidance element 46.

The at least one coextensive track member 30 comprises an upstanding member 32 and a flange member 34. The upstanding member 32 protrudes perpendicularly from the inside surface 22 of one side of the base member 20. The flange member 34 protrudes perpendicularly from the distal end of the upstanding member 32 and extends partially over the inside surface 22 of the base member 20.

Furthermore, a flap member 36 extends from the inside surface 22 of the base member 20 along the side opposite that of the coextensive track member 30 and partially covers the inside surface 22 of the base member 20 but does not extend to the flange member 34.

The access slot 38 is located in the space between the flange member 34 and the flap member 36. It extends from the open end 40 towards the closed end 42 and has a width 37 wide enough for at least one finger 72 (shown in FIG. 9C) to make active contact with ammunition cartridges 50 (shown in FIG. 6).

Figure 4:
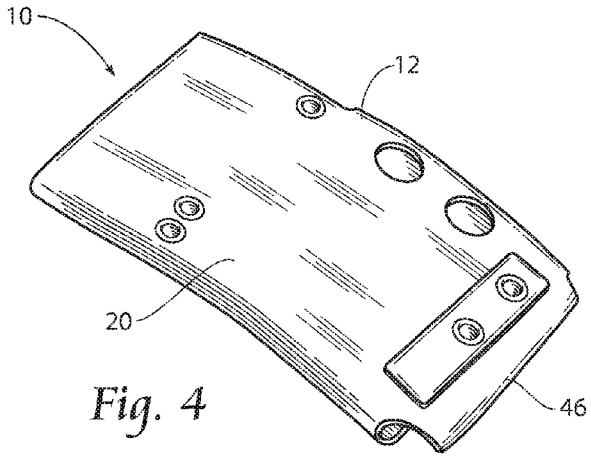
FIG. 4 is a rear perspective view of the reloader of FIG. 1 but without a rear aperture.

Moreover, the embodiment shown in FIG. 2 illustrates an aperture 24 located in the base member 20. The aperture 24 may be advantageous when the loader 10 is used to reload a bolt-action rifle employing a top-mounted scope (as shown in FIGS. 9A-9G) because it provides a relief in which the scope may enter and not interfere with the loader 10. The shape of the aperture 24 should only be viewed as illustrative as it may take any shape. Additionally, it also contemplated that the base member 20 may not include the aperture 24, as shown in FIG. 4.

Figure 8:
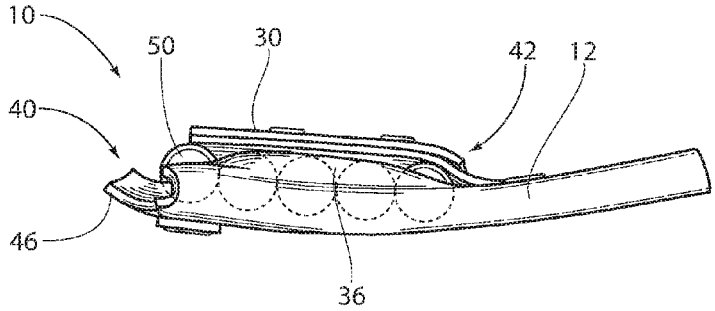
FIG. 8 is a side view of the reloader according to the present invention and showing ammunition in phantom.

Moreover, the loader 10 comprises a guidance element 46 extending from the base member 20 at the open end 40. With reference to FIG. 8, the guidance element 46 has an arcuate shape and extends upward and away from the base member 20. The guidance element 46 may have a width 48 capable of fitting within the opening of a loading/ejection port 64 of a firearm 60 as shown in FIGS. 9E and 9F. Moreover, the arcuate form of the guidance element 46 acts as a guide for the ammunition to follow as they are introduced into the magazine. It should be noted that any directional reference is purely for illustrative purposes only and should not be construed as limiting the present invention to any certain orientation.

Furthermore, as the width 44 of the body 12 is preferably larger than the width 66 of a loading/ejection port 64 (FIG. 9A), the loader 10 is prevented from entering the loading/ejection port 64 too far during the act of loading. This feature also provides tactile feedback to an operator 70, permitting him to position the loader properly within the loading/ejection port 64, potentially without looking; thus allowing the operator 70 to keep his eyes down range.

Figure 5:
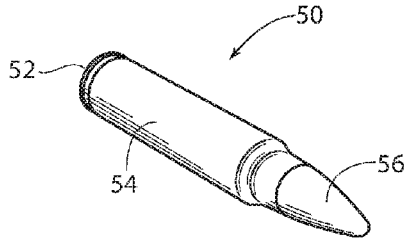
FIG. 5 is a perspective view of a piece of ammunition.

An illustrative piece of ammunition, or a cartridge 50, is shown in FIG. 5. The cartridge 50 comprises a rim 52, a case 54, and a bullet 56. Cartridges 50 for use with the present invention may be of varying caliber, such as .270, .30-06, or .300, or any other caliber that may be used with a bolt action rifle loaded in the manner described herein.

Figure 6:
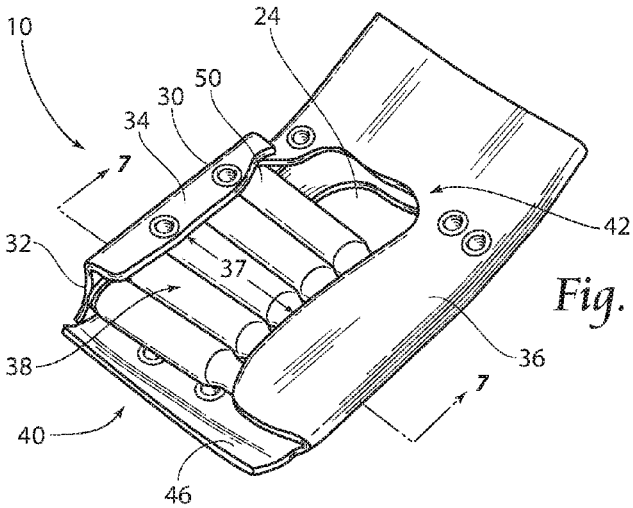
FIG. 6 is a front perspective view of the reloader illustrated in FIG. 1 but with ammunition installed.
Figure 7:
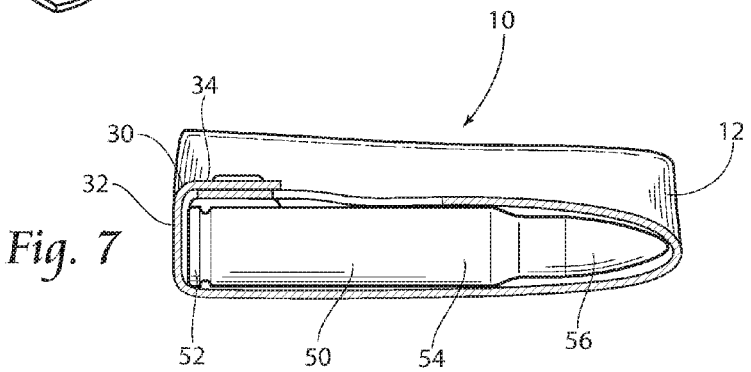
FIG. 7 is a cross-section view of the reloader along line 7-7 of FIG. 6.

FIG. 6 shows the loader 10 filled with cartridges 50. The rims 52 of the cartridges 50 are positioned within the coextensive track 30 and the bullets 56 of the cartridges 50 are located within the flap member 36. A better view of the positioning of the cartridge 50 within the loader 10 may be seen in FIG. 7.

It is further contemplated by the invention that the maximum number of cartridges 50 in the loader 10 equals the capacity of the corresponding firearm magazine for quick and easy loading. However, a loader 10 may have a capacity greater than or lesser than the capacity of the respective firearm magazine and remain within the purview of the present invention.

The overall arcuate shape of the loader 10 is more easily seen in FIG. 8, as is the arcuate shape of the guidance element 46. Furthermore, FIG. 8 illustrates how the coextensive track 30 is of a more structured shape because many cartridges have similar diameter rims 52, while the flap member 36 more or less conforms to the size and shape of the bullet 56 of a cartridge 50 because bullet size and shape may vary for different calibers of ammunition. The flap member 36 may be more flexible to allow it to remain in contact with ammunition of different calibers.

Figure 9A:
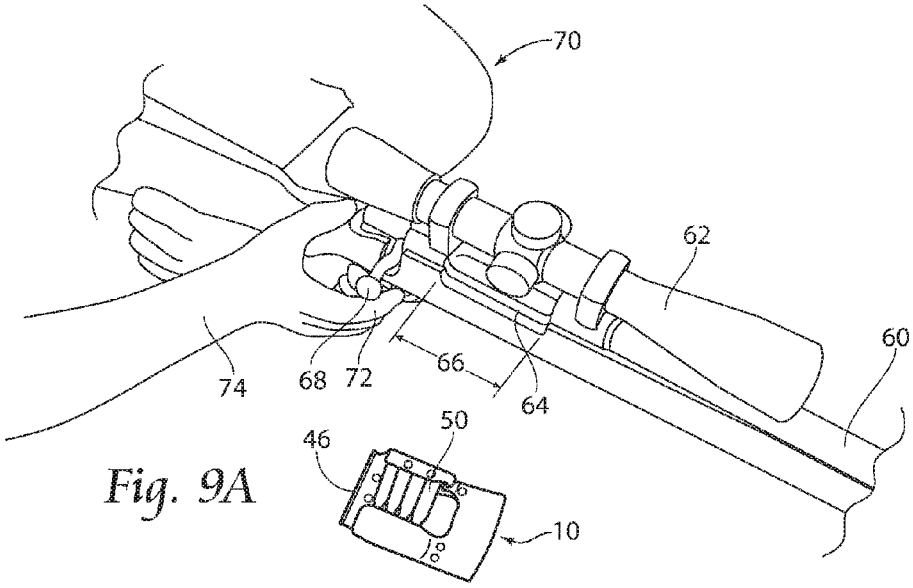
FIGS. 9A-9H illustrate a method of using the reloader to reload a bolt-action rifle.
Figure 9B:
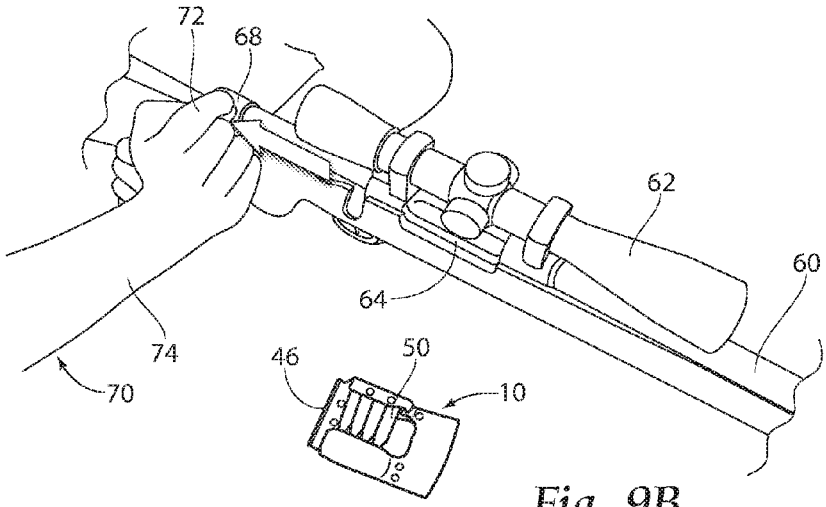
Figure 9C:
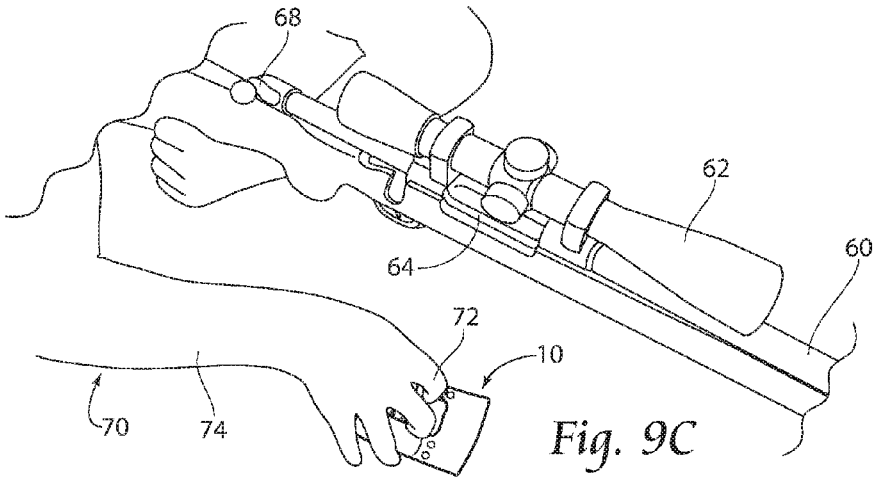
Figure 9D:
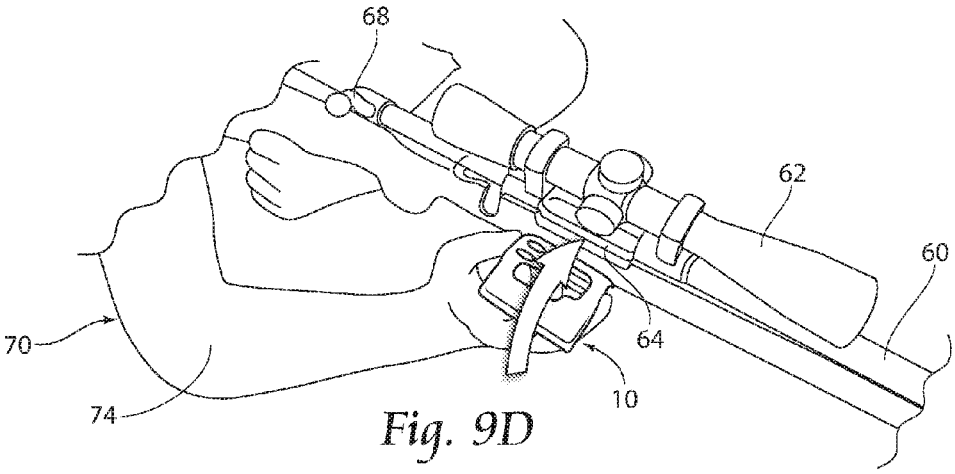
Figure 9E:
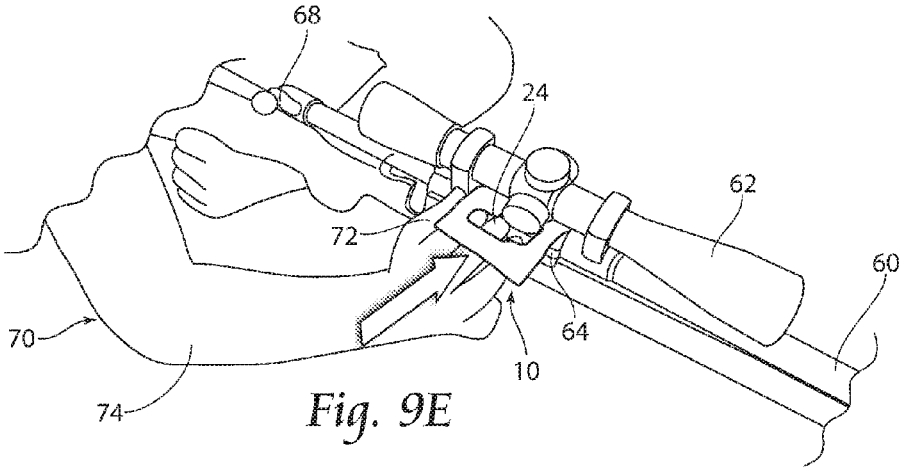
Figure 9F:
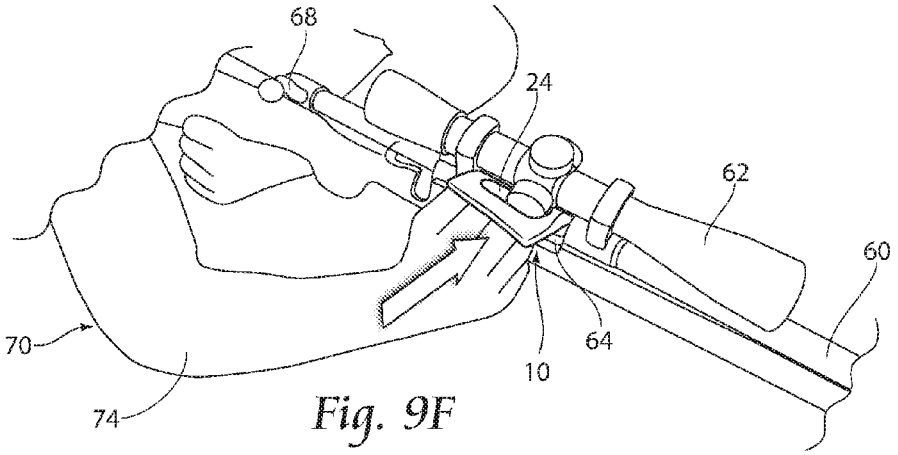
Figure 9G:
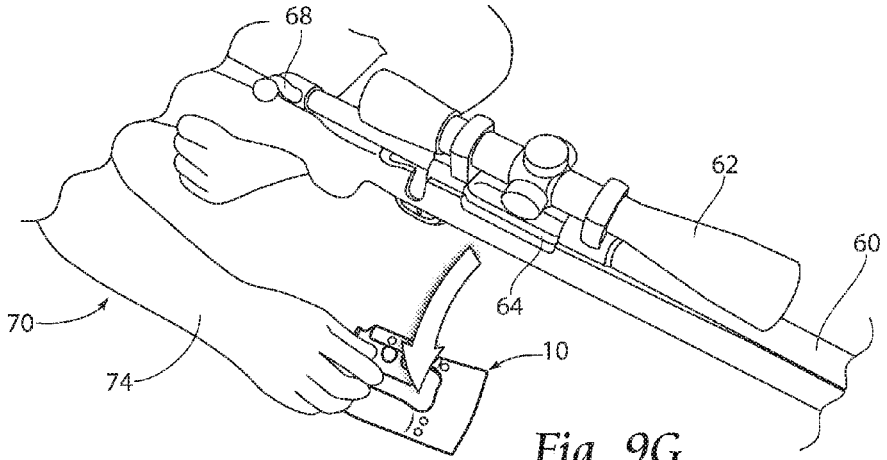
Figure 9H:
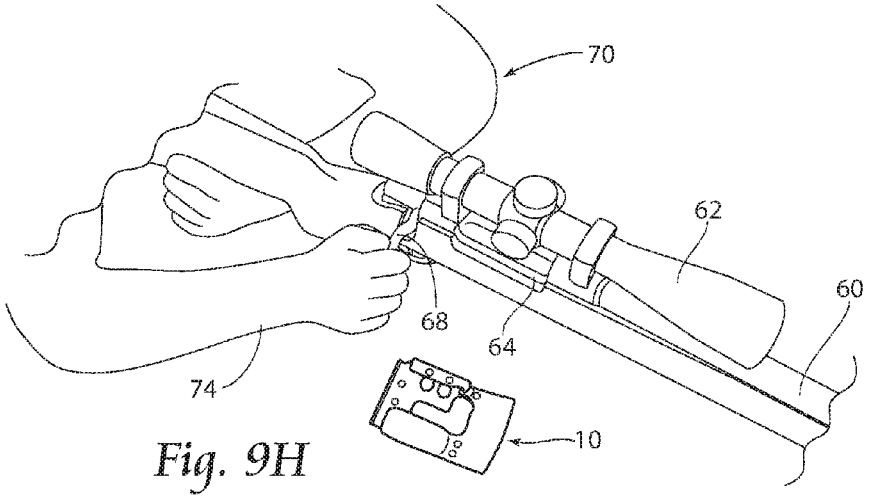

The loader 10 is shown in use in FIGS. 9A-9H. In FIG. 9A the loader 10 has already been filled with ammunition cartridges 50. To fill the loader 10, the operator 70 inserts an ammunition cartridge 50, with the rim 52 in the coextensive track member 30 and the bullet 56 under the flap member 36, and moving the cartridge 50 along the inside surface 22 of the base member 20, with access to the case 54 of the cartridge 50 through the access slot 38. The operator 70 may continue to move the cartridge 50 along the inside surface 22 until it abuts the closed end 42 and repeat the filling process with another cartridge 50, or, alternatively, the operator 70 may load another cartridge 50 into the loader 10 and thereby move the first loaded cartridge 50 towards the closed end 42 with the loading of the following cartridge 50.

FIG. 9B illustrates the operator 70 opening the loading/ejection port 64 by pulling the bolt 68 back. In FIG. 9C the operator 70 is shown taking hold of the loader 10 and moving it into position (FIG. 9D) by placing the guidance element 46 in contact with or engaging with the loading/ejection port 64. Once in position, the operator 70 uses his fingers 72 to guide the ammunition 50 into the magazine (hidden) by applying a downward force to the case 54 of the piece of ammunition 50 positioned nearest the closed end 42 in the direction of the arrow (FIGS. 9E and 9F). After the ammunition 50 has been loaded, the loader 10 may be placed to the side where it may be refilled. The operator 70 then reengages the bolt 68 thereby reading the firearm 60 for firing.

It should be noted that the loader 10 may be operated with only one hand. This allows the operator 70 to maintain her position with the only movement required being that of her loading arm 74. This is advantageous as it promotes fast reloading time in addition to reducing the time it takes to go from loading the firearm 60, back to a ready to shoot position. It also minimizes the amount of body movement, which in some situations may be very important as excessive body movement may draw attention to the operator's position.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A method of loading a firearm with at least one ammunition cartridge, the cartridge having a rim, a casing, and a bullet, the firearm including a loading port having a loading port width, the method comprising the steps of:

providing an ammunition loading apparatus, said ammunition loading apparatus having a body including a body width; an open end; a closed end opposite the open end; a track member extending between the open end and the closed end along one side of the body; a flap member opposite the track member; an access slot between the track member and the flap member, the access slot extending from the open end towards the closed end, wherein the closed end extends laterally from the access slot and away from the open end; the open end having a first thickness and the closed end having a second thickness, wherein the first thickness is greater than the second thickness; the body having an arcuate profile perpendicular to the body width, the arcuate profile extending from the open end to at least the closed end; and a guidance member, having a guidance member width, protruding from the open end of the body; wherein the flap member is flexible and configured to adapt to the shape of the bullet; and wherein the guidance member width is configured to be less than the loading port width of the firearm and the body width is configured to be greater than the loading port width of the firearm;

placing the at least one ammunition cartridge into the ammunition loading apparatus with the rim in the track member and the bullet in the flap member;

aligning the guidance member within the loading port with the at least one ammunition cartridge in loading orientation;

applying a downward pressure to the casing of the at least one ammunition cartridge through the access slot; and transferring the at least one ammunition cartridge from the apparatus to the firearm.

2. The method of claim 1 including the further step of providing said guidance member with an arcuate profile.

3. A method of loading a firearm with at least one ammunition cartridge, the cartridge having a bullet and a rim opposite the bullet, the firearm having a loading port having a loading port width, the method comprising the steps of:

providing an ammunition loading apparatus, said ammunition loading apparatus having a body with four sides, a body width and a base member, wherein at least one of said four sides is an open end, a side opposite said open end is a closed end, another of said four sides includes a track member extending between said open end and said closed end, opposite the track member is a flap member extending between the open end and the closed end, an access slot located between the track member and the flap member, the access slot extending from the open end towards the closed end, wherein the closed end extends laterally from the access slot and away from the open end; the open end having a first thickness and the closed end having a second thickness, wherein the first thickness is greater than the second thickness; the body having an arcuate profile perpendicular to the body width extending from the open end to at least the closed end; a guidance member, having a guidance member width, protruding from the open end; wherein the flap member is flexible and configured to adapt to the shape of the bullet; and wherein the guidance member width is configured to be less than the loading port width of the firearm and the body width is configured to be greater than the loading port width of the firearm;

placing the at least one ammunition cartridge into the ammunition loading apparatus with the rim in the track member and the bullet under the flap member;

aligning the guidance member within the loading port;

applying pressure on the at least one ammunition cartridge through the access slot; and transferring the at least one ammunition cartridge from the apparatus to the firearm.

4. The method of claim 3 including the further step of providing said guidance member with an arcuate profile.

* * * * *